United States Patent [19]

Siman

[11] Patent Number: 4,707,678

[45] Date of Patent: Nov. 17, 1987

[54] CONSOLIDATED MAGNETIC CORE CONTAINING AMORPHOUS METAL

[75] Inventor: Jaime E. Siman, Watkinsville, Ga.

[73] Assignee: Westinghouse Electric Corp., Pittsburgh, Pa.

[21] Appl. No.: 909,651

[22] Filed: Sep. 22, 1986

Related U.S. Application Data

[62] Division of Ser. No. 699,378, Feb. 7, 1985, Pat. No. 4,648,929.

[51] Int. Cl.[4] ..... H01F 27/24

[52] U.S. Cl. ..... 336/210; 336/212; 336/213; 336/219

[58] Field of Search ..... 336/213, 219, 234, 96, 336/210, 212, 100; 148/31.55

[56] References Cited

U.S. PATENT DOCUMENTS

| | | | |
|---|---|---|---|
| 2,744,204 | 5/1956 | MeGuiness | 336/96 X |
| 3,074,039 | 1/1963 | Ford | 336/219 X |
| 4,615,106 | 10/1986 | Grimes et al. | 336/213 X |

FOREIGN PATENT DOCUMENTS

| | | | |
|---|---|---|---|
| 2024931 | 12/1971 | Fed. Rep. of Germany | 336/96 |
| 3346284 | 7/1984 | Fed. Rep. of Germany | 148/31.55 |
| 161307 | 9/1983 | Japan | 336/219 |
| 65502 | 4/1985 | Japan | 336/100 |
| 749370 | 5/1956 | United Kingdom | 336/96 |
| 2111316 | 6/1983 | United Kingdom | 336/213 |

*Primary Examiner*—Thomas J. Kozma
*Attorney, Agent, or Firm*—D. R. Lackey

[57] ABSTRACT

A magnetic core containing amorphous metal, suitable for use with electrical inductive apparatus, such as transformers. The desired physical dimensions of the magnetic core are maintained, without adversely stressing the core, by a composite, conformal coating applied to the core edges. The composite coating includes a rigid high strength outer structure and a low stress, adhesive inner structure which cooperatively provide mechanical support and stress protection for the magnetic core, while maintaining its configuration.

7 Claims, 15 Drawing Figures

FIG. 3
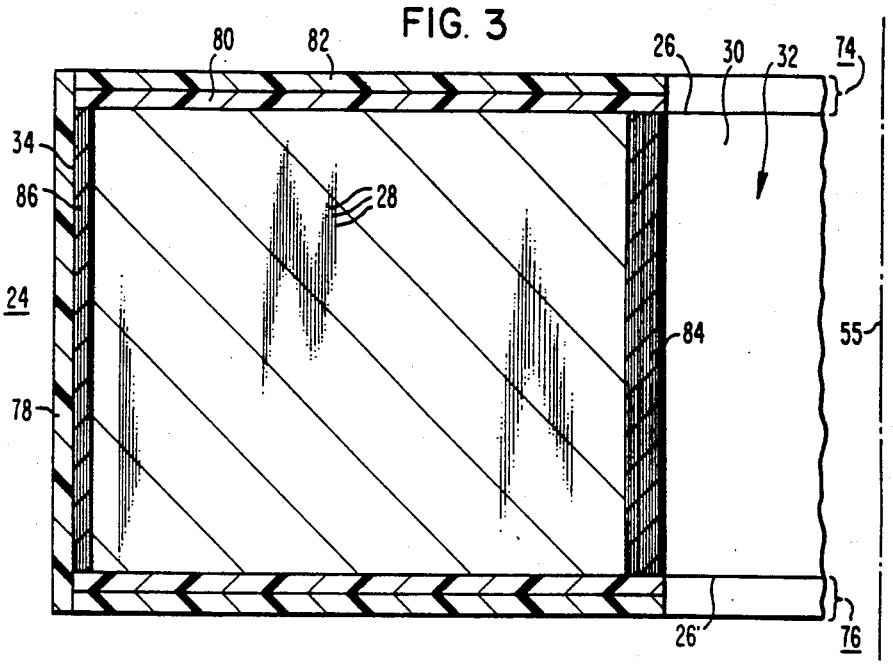
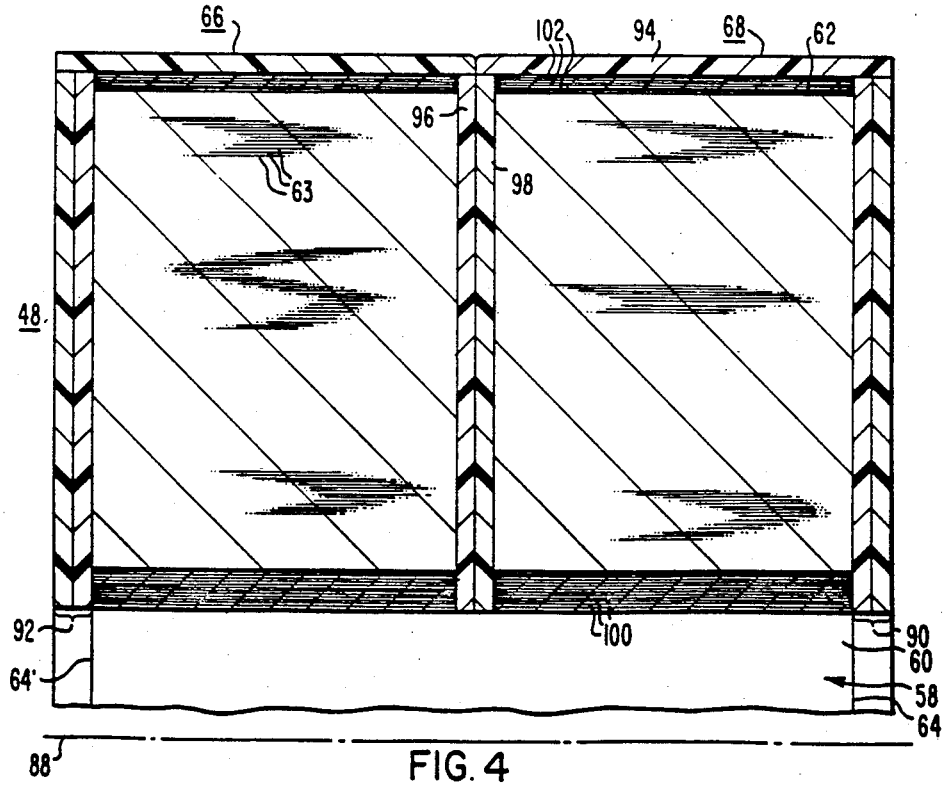
FIG. 4

CONSOLIDATED MAGNETIC CORE CONTAINING AMORPHOUS METAL

This is a division of Ser. No. 699,378 filed Feb. 7, 1985, now U.S. Pat. No. 4,648,929.

BACKGROUND OF THE INVENTION

1. Field of the Invention

The invention relates in general to magnetic cores for electrical inductive apparatus such as transformers and reactors, and more specifically to magnetic cores containing an amorphous metal.

2. Description of the Prior Art

The use of amorphous metal in the magnetic core of electrical inductive apparatus is desirable when core losses are important, as the core losses in amorphous metal cores are substantially lower than with regular grain oriented electrical steel. Magnetic cores wound from a strip of amorphous metal, however, are not self-supporting, and will collapse if not otherwise supported if the male portion of the winding mandrel is removed from the core window. If an amorphous core is not operated in the as-wound configuration, the core losses increase. Amorphous metal is also very brittle, especially after anneal, which is required to optimize the magnetic characteristics of the core. Care must be taken to prevent slivers and flakes of amorphous metal from being carried by the liquid coolant of the associated electrical inductive apparatus to areas of high electrical stress.

Thus, it would be desirable to economically, consolidate such cores, making them dimensionally stable as well as enabling them to be handled during assembly, and to operate in their intended environment with associated electrical windings, without significantly increasing the core losses. It would also be desirable to economically prevent chipping of the core during handling and assembly, as well as during operation, to ensure that core particles are not liberated into the coolant stream of the apparatus. These objectives should be achieved without resorting to box-like core enclosures, costly molds, and the like, as the multiplicity of core sizes make such "solutions" forbiddenly expensive.

SUMMARY OF THE INVENTION

Briefly, the present invention is a new and improved magnetic core which includes amorphous metal, and methods of constructing same. The new and improved magnetic core is consolidated with a conformal composite coating applied to the edges of the lamination turns. A new and improved method is disclosed which prevents the conformal coating from penetrating or seeping between the lamination turns, as any such penetration would stress the core and increase its losses.

The conformal composite coating has two basic parts, a low stress insulative inner structure and a relatively rigid, high strength outer structure. The high strength outer structure provides the necessary structural support to make the core self-supporting over the complete operating temperature range of the associated apparatus, while the inner structure enables the outer structure to be applied to the core without applying significant stresses to the core. The conformal composite structure protects the core from handling stresses, it protects the core from stresses developed during coil winding, and it withstands thermal cycling stresses created in the operating environment. The conformal composite coating includes organic resins which are compatible with the usual transformer coolants or liquid dielectrics, such as mineral oil, and the coating is applied without the need for molds, using high speed production line techniques.

BRIEF DESCRIPTION OF THE DRAWINGS

The invention may be better understood, and further advantages and uses thereof more readily apparent, when considered in view of the following detailed description of exemplary embodiments, taken with the accompanying drawings in which:

FIG. 3 is a cross-sectional view of the magnetic core shown in FIG. 1, taken between and in the direction of arrows III—III;

FIG. 4 is a cross-sectional view of the rectangular magnetic core shown in FIG. 2, taken between and in the direction of arrows IV—IV;

DESCRIPTION OF THE PREFERRED EMBODIMENTS

Figure 1:
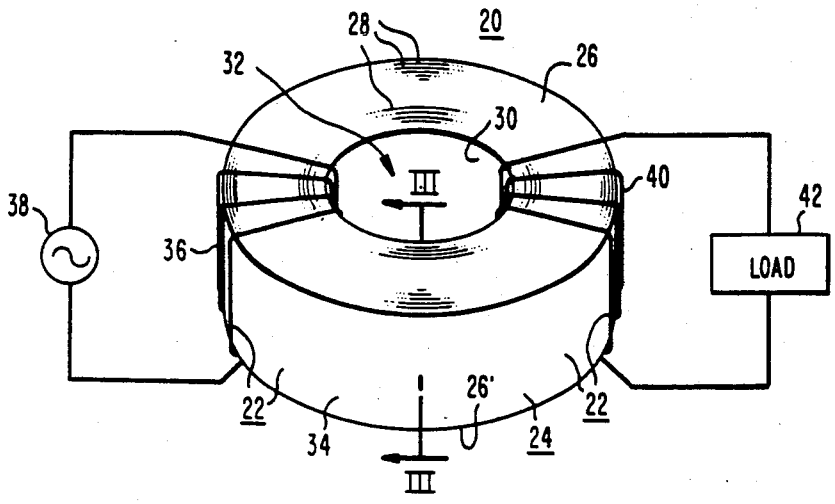
FIG. 1 is a diagrammatic and schematic representation of an electrical transformer having a wound torodial magnetic core which may be constructed according to the teachings of the invention.
Figure 2:
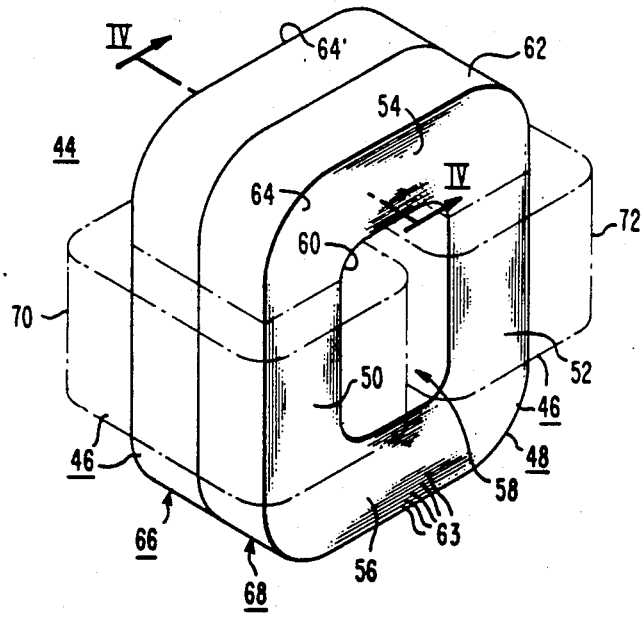
FIG. 2 is a perspective view of a transformer having a wound rectangular magnetic core which may be constructed according to the teachings of the invention.

Referring now to the drawings, and to FIGS. 1 and 2 in particular, there is shown electrical transformers which may be constructed according to the teachings of the invention. FIG. 1 illustrates a torodial transformer 20 having a core-coil assembly 22. The core-coil assembly 22 includes a wound magnetic core 24 which is wound on a mandrel having a round male portion. In the invention, the magnetic core is either partially or wholly constructed of amorphous metal, such as Allied Corporation's 2605SC material ($Fc_{81}$ $B_{13.5}$ $Si_{3.5}$ $C_2$ atomic percent), but other amorphous alloys may be used.

Magnetic core 24 is wound from one or more thin, elongated strips of metal to form flat sides on opposite sides of the core, such as flat sides 26 and 26', which sides expose edges of closely adjacent lamination turns 28 which make up the core. The innermost lamination turn defines an inner surface 30 which in turn defines a core window 32, and the outermost lamination turn defines the outer periphery or surface 34 of the magnetic core. In a preferred embodiment, at least a few of the innermost and outermost lamination turns are formed of grain oriented electrical steel, but the invention is also applicable to a magnetic core containing 100% amorphous metal.

The coil of the core-coil assembly 22 includes a primary winding 36, adapted for connection to a source 38 of alternating potential, and a secondary winding 40 adapted for connecting to a load circuit 42. Winding 36 and 40 are shown schematically. In practice they would be concentric and distributed uniformly about the core.

FIG. 2 illustrates a rectangular, core-form transformer 44 having a core-coil assembly 46. The core-coil assembly 46 includes a wound magnetic core 48 which is wound on a mandrel having a substantially rectangular cross-sectional configuration, to form first and second winding leg portions 50 and 52, respectively, and upper and lower yoke portions 54 and 56, respectively, which define a rectangularly shaped window 58. Core 48 has inner and outer surfaces 60 and 62 defined by the innermost and outermost lamination turns, respectively. Except for its configuration, core 48 may otherwise be constructed of the same materials described relative to the magnetic core 24 shown in FIG. 1 and it includes two flat sides 64 and 64' on opposite sides of the core, which expose the edges of the lamination turns 63.

As illustrated, magnetic core 48 may be built up by stacking similar core sections together, such as core sections 66 and 68, after each section is dimensionally stabilized in accordance with the teachings of the invention. The core 24 shown in FIG. 1 may also contain more than one core section.

The coil of the core-coil assembly 46 includes primary and secondary windings, as shown in FIG. 1, with each winding including electrically interconnected concentrically disposed sections on each winding leg, shown generally at 70 and 72 on winding legs 50 and 52, respectively.

FIG. 3 is a cross-sectional view of magnetic core 24 shown in FIG. 1, taken between and in the direction of arrows III—III, with magnetic core 24 being consolidated according to the teachings of the invention. A central axis 55 through window 34 is vertically oriented in the usual operating position of magnetic core 24. In general, similar conformal, composite coatings are formed on each of the flat sides of core 24, such as coatings 74 and 76 on flat sides 26 and 26', respectively. A conformal coating 78 is also formed on the outer surface 34. Since the conformal coatings 74 and 76 are of like construction, only the conformal coating 74 will be described in detail.

Conformal coating 74 is a composite, including an inner, low stress, adhesive inner structure 80 bonded to the edges of the lamination turns 28. "Low stress" means that inner structure 80 is selected and applied such that it exerts very little stress on the lamination turns. "Adhesive" means that inner structure 80 is selected to bond tenaciously to the electrical steel of which the core is made. Conformal coating 74 also includes an outer, more rigid, much higher strength structure 82 which is bonded to the lower strength, less rigid inner structure 80. The inner low stress structure 80 is constructed to grasp or adhere to the edges of the lamination turns, without any material extending between the lamination turns. In other words, the bonding only takes place between the structure 80 and the surfaces which define the edges of the lamination turns. Thus, structure 80 does not add stresses to core 24 by solidifying and curing between the lamination turns 28. Curing of resin between turns 28 would not only stress the core with curing related stresses, but also with thermal expansion related stresses during operation of the associated apparatus.

The outer high strength structure 82 of conformal coating 74 is bonded directly to the low stress structure 80. The primary function of structure 82 is to hold the core 24 in the desired configuration, and make it self-supporting over the operating temperature range of the apparatus. Any stresses developed during the application of structure 82 to structure 80 are absorbed by structure 80 without transmission of stresses to the core. The two structures of the composite coating 74 cooperate to allow the consolidated core to be handled and to allow windings 36 and 40 to be wound thereon without transmitting damaging mechanical stresses to the core which would significantly increase core losses.

Conformal coating 78 is applied and bonded to the outer curved surface 34 of core 24. It is a structure similar to structure 80 of the composite coating, and it extends completely across the width of the core, between its flat surfaces and across the thin conformal coatings 74 and 76.

As illustrated in FIG. 3, magnetic core 24 is a "mixed" core, containing both amorphous metal and grain oriented electrical steel, which is the preferred embodiment of the invention. A predetermined number of inner laminations 84, and a predetermined number of outer laminations 86 are formed of grain oriented electrical steel, while the remaining laminations 28 are formed of amorphous metal. This arrangement requires less strength in the conformal coatings, and thus thinner conformal coatings may be used. Also, the grain oriented electrical steel, along with the conformal coatings, protect the amorphous metal from adverse mechanical stresses and ensures that no flakes or particles of the amorphous metal will be created which may adversely affect the operation of the associated apparatus.

FIG. 4 is a cross-sectional view of magnetic core 48 shown in FIG. 2, taken between and in the direction of arrows IV—IV, with magnetic core 48 being consolidated according to the teachings of the invention. A central axis 88 through window 58 is horizontally oriented in the usual operating position of magnetic core 48. The operating position of core 48 requires that the conformal coatings provide mechanical support during the operation of the transformer, and not just during handling, unlike the operating position of the torodial core 24 shown in FIG. 1. In general, similar conformal, composite coatings are formed on each of the flat sides of magnetic core 48, such as coatings 90 and 92 on flat sides 64 and 64', respectively, and a conformal coating 94 is formed on the outer surface 62. If magnetic core 48 is built up of core sections stacked together, such as sections 66 and 68, only those surfaces which define the outermost flat surfaces of the final core configuration will have the composite conformal coatings. The flat surfaces of the core sections which are adjacent to one another and which are bonded together require only the low stress conformal coating, such as coatings 96 and 98 on core section 66 and 68, respectively. Conformal coatings 90 and 92 are composites, similar to the composite coating 74 of core 24, and thus they need not be described in detail. Conformal coatings 94, 96 and 98 are similar to conformal coatings 78 on core 24, and thus they need not be described in detail.

As illustrated in FIG. 4, core 48 is a "mixed" core, containing both amorphous metal and grain oriented electrical steel. A predetermined number of inner laminations 100, and a predetermined number of outer laminations 102 are formed of grain oriented electrical steel, while the remaining laminations 63 are formed of amorphous metal.

The characteristics of both the torodial and rectangular core-form cores 24 and 48 shown in FIGS. 1 and 2, respectively, will become even more apparent when new and improved methods of constructing the cores according to the teachings of the invention are described in detail.

Figure 5:
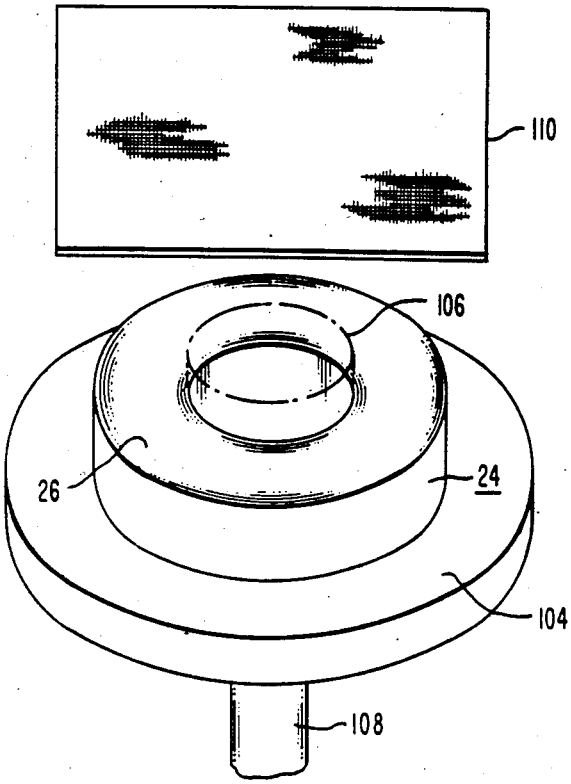
FIG. 5 is a perspective view of a step in a new method of creating a low stress structure of a composite conformal coating on a wound torodial core, which includes the application of a foraminous or porous sheet to the flat core edges on one side of the core.

More specifically, as shown in FIG. 5, magnetic core 24 is wound on a suitable mandrel which includes a flat plate 104 and a round male portion 106. The core 24 is annealed at a temperature of about 400° C., with the mandrel in place, to maintain the desired torodial core configuration during anneal. The flat plate 104 of the mandrel is then placed on a table, or on a rotatable shaft 108, as desired, and the male portion 106 of the mandrel is then removed. The low stress structure 80 of the composite conformal coating 74 is then bonded to the uppermost flat side 26 of core 24. A first step in a method of constructing structure 80 is to obtain a sheet 110 of foraminous or porous material, such as fiberglass cloth. A two (2) mil thick cloth grade 1080 with sizing B 220 obtainable from Bedford Weaving Mills, Inc., of Bedford, Va., has been found to be excellent for use with a UV-curable acrylated epoxy resin. The thickness and porosity of the cloth are selected to provide a predetermined flow rate for liquid resin applied to one side thereof, and the sizing is selected for resin compatibility, to enable the liquid resin to wet the fiberglass cloth.

Liquid resin cannot be directly applied to the edges of the lamination turns 28, as it will immediately flow between the turns and stress the core when it is gelled. The polymerization or curing of the resin causes it to shrink in volume from the liquid state, resulting in tremendous mechanical stresses on the lamination turns which cannot be tolerated. In addition to preventing resin penetration between the lamination turns during the formation of the conformal coating, the fiberglass cloth also reduces the effect on core performance of resin shrinkage in the coating itself, during cure of the resin. The fiberglass cloth also functions favorably as part of the conformal coating during operation of the core in the associated electrical inductive apparatus, as it reinforces the coating and it reduces the effect on core performance during thermal cycling, which otherwise would be caused by the relatively high coefficient of thermal expansion of the resin. Thus, the porous sheet 110 is placed on the flat side 26. As illustrated, it need not be precut to the size of the core 24, as it is easily trimmed at a later stage of the process.

Figure 6:
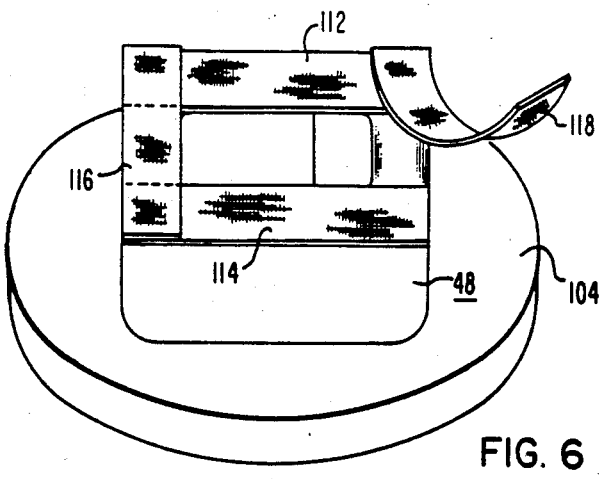
FIG. 6 is a perspective view similar to that of FIG. 5, except illustrating a modification which may be used with a wound rectangular core.

As shown in FIG. 6, when the rectangular core 48 shown in FIG. 2 is being processed, the porous initial layer, as well as later layers of reinforcing fabric, may be built up from a plurality of lengths of standard width strips of fiberglass, such as strips 112 and 114 on the leg portions, and strips 116 and 118 on the yoke portions. The strips may overlap at the corners of the core.

The next step of the process involves the application of a liquid resin to the porous sheet 110. The liquid resin selected must be radiation gellable, and it must meet several other requirements. The resin must wet the electrical steel and show good adhesion to it when cured. It must also cure with a minimum amount of residual stress so it can withstand thermal cycling and have a minimum impact on core performance. The resin should radiation cure into a B-stage condition so that a complete and perfect consolidation of all layers of the conformal coating can be obtained during a post-cure operation using heat. The resin must also gel very quickly when irradiated, so that gelling will occur immediately after the permeation of sheet 110 and the wetting of the edges of the lamination turns, to prevent seepage of the resin into the lamination turns. The resin must be flexible enough to shield and protect the magnetic core from stresses and strains, regardless of when and how they are generated or applied to the core.

A cross-linkable resin which possesses all of the essential characteristics, B-stageable in one second with ultraviolet light, is disclosed in U.S. Pat. No. 4,481,258 entitled "UV CURABLE COMPOSITION AND COIL COATINGS". This acrylated epoxy resin has been found to posses exceptional life in a transformer environment and it easily withstands the thermal cycling associated with this severe thermal and chemical environment. It also possesses the requisite flexibility (180° bend with 1/16th inch diameter mandrel).

Figure 7:
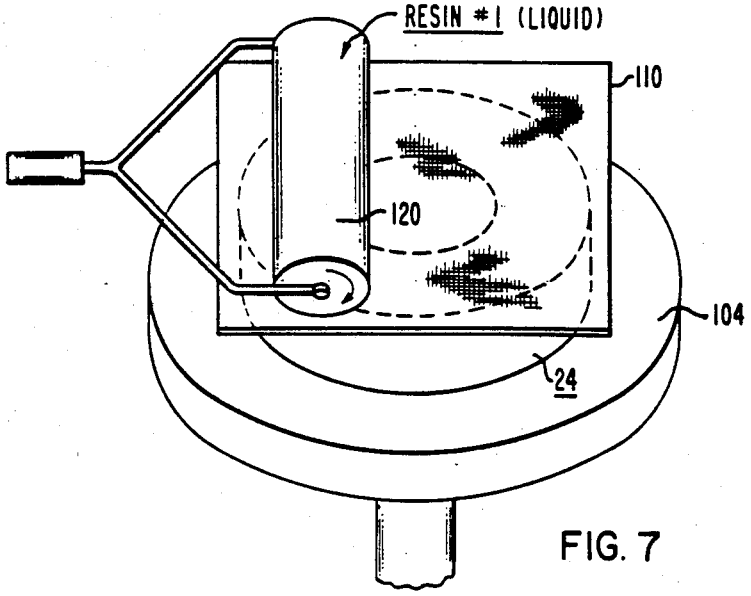
FIG. 7 is a perspective view of another step in the new and improved method, which includes the application of a liquid, radiation gellable organic resin to the porous sheet applied in the step shown in FIG. 5.

The resin applied to sheet 110, which will be referred to as resin No. 1, may be brushed, sprayed, or rolled onto the surface of the porous sheet 110. It is only desired to just impregnate sheet 110, using as little resin as possible. This provides the optimum structure, and it controls resin transfer from the sheet to the core. Thus, a controlled amount of resin is preferably applied, such as via a roller 120, as indicated in FIG. 7. Sufficient resin should be applied to the sheet to impregnate it to the point where the impregnated sheet will firmly bond to the edges of the core when the resin is gelled. The amount of resin and its viscosity, and the thickness and porosity of sheet 110 are all selected such that the sheet 110 will tend to hold the resin, just wetting the extreme edges of the lamination turns. A viscosity of about 6000 cp at 26° C. is suitable with the specifications for the sheet hereinbefore mentioned.

Figure 8:
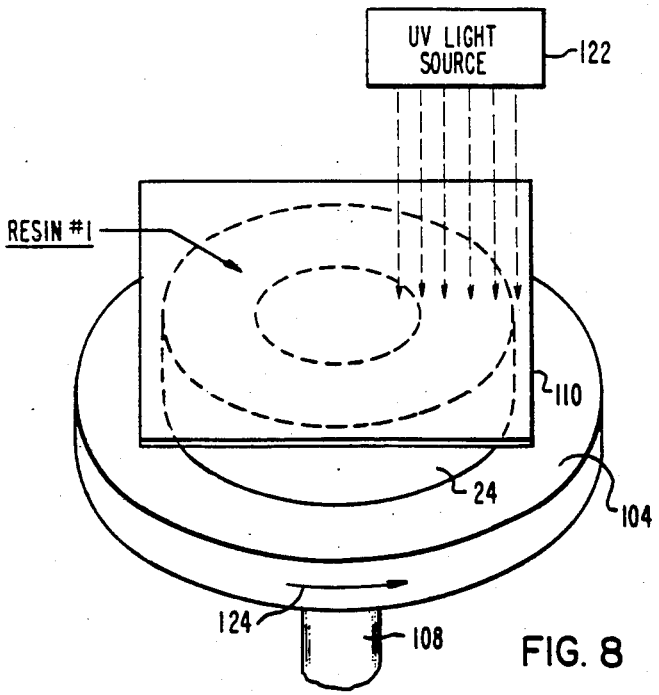
FIG. 8 illustrates another step in the method of creating the inner, low stress structure of the composite, conformal coating, which includes a rapid radiation gel of the liquid resin.

As soon as sheet 110 has been impregnated with resin No. 1, the resin is immediately B-staged with radiation, such as ultraviolet light from a UV light source 122 shown in FIG. 8. Light source 122 may include Fusion Systems 300 watt "H" lamps, for example. If plate 104 is rotatable, as indicated by arrow 124, it may be rotated to pass the resin impregnated sheet 110 through light from source 122.

The number of layers in the flexible structure 80 depends upon the physical size of the magnetic core. In a preferred embodiment for normal distribution transformer core sizes, at least one more layer of fiberglass cloth is included in structure 80. Since the core edges have now been sealed, the next layer may be started by applying resin No. 1. i.e., the flexible resin, directly to the resin impregnated sheet 110. While this resin is liquid, a sheet of fiberglass cloth is applied to the wet resin, and it is pressed uniformly into the wet resin, such as with a roller. Since the next sheet of fiberglass cloth need not be selected for its characteristic of transmitting resin from one side to the others which was important for sheet 110, it may be selected primarily with mechanical strength in mind. Thus, a heavier fiberglass cloth, such as grade 2116, may be selected. The resin impregnated next layer of fiberglass cloth is irradiated with ultraviolet light, to advance the cure of the resin to the B-stage. Additional layers may now be applied, as required, exactly the same as the second layer.

When the low stress structure 80 has been completed, it may be trimmed to the edges of the core, or the trimming may be performed after the high strength structure B2 has been applied, as desired. If a few lamination turns of grain oriented steel are located at the inside and outside of the core 24, the trimming may cut the coating structure close to the core edges without danger of nicking or flaking amorphous metal from the core. The grain oriented steel also adds to the mechanical stability of the structure and it prevents flakes of amorphous metal from being dislodged from the core surfaces. If the core is constructed entirely or amorphous metal, care should be taken during trimming to keep from damaging the core edges. When the core is constructed entirely of amorphous metal, it may also be desirable to leave an overhang while trimming, as will be hereinafter explained.

Figure 9:
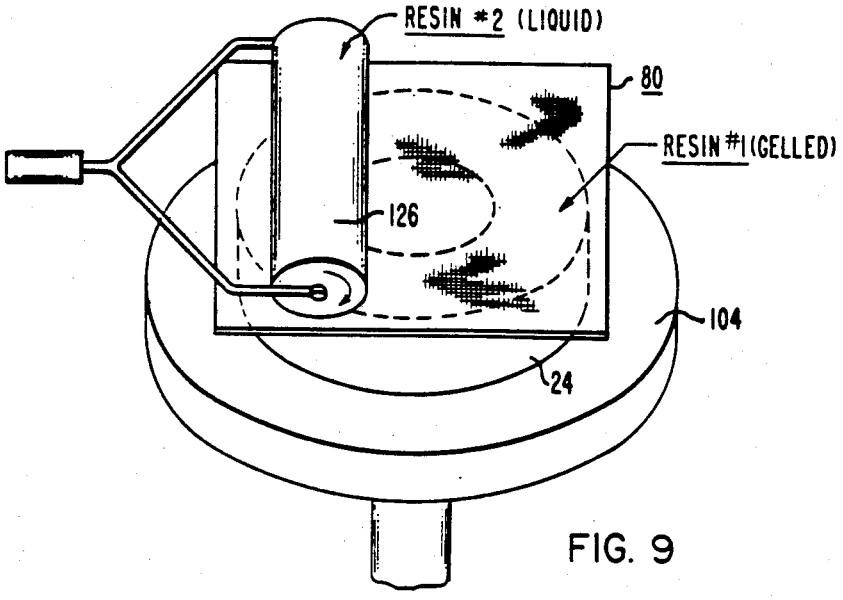
FIG. 9 illustrates a step in the formation of an outer, high strength structure of the composite, conformal coating started in FIG. 5, which includes applying a liquid organic resin, selected for its high tensile strength when cured, to the low stress inner structure of the coating.

The next step of the method is to bond the high strength structure 82 to the low stress structure 80. This is accomplished by applying a liquid, radiation curable resin directly to structure 80, as shown in FIG. 9, such as via a roller 126, or by spraying or brushing the resin. The characteristics of this resin, which will be called resin No. 2, are different than those of resin No. 1. Resin No. 2 must be able to adhere or bond tenaciously to resin No. 1. It must have a very high tensile strength at room temperature, and also at the elevated operating temperatures of the associated transformer. It must have good dimensional stability at all operating temperatures, and it must be compatible with the liquid dielectric used in the associated apparatus, such as mineral oil. A cross-linkable resin which possesses all of these characteristics is disclosed in concurrently filed application Ser. No. 699,373, filed in the name of W. Su, now U.S. Pat. No. 4,618,697. While resin No. 1, the low stress resin used in structure 80, has a tensile strength at break of less than 100 psi at 100° C. (2500 psi at room temperature), resin No. 2, which is made from a high functionality acrylated aromatic polyester urethane, has a tensile strength at break of 900 psi at 100° C. (over 7000 psi at room temperature). Resin No. 2 may also be rapidly UV cured in relatively thick coatings, such as 100 mils, which facilitates the manufacture of the high strength structure 82.

Figure 10:
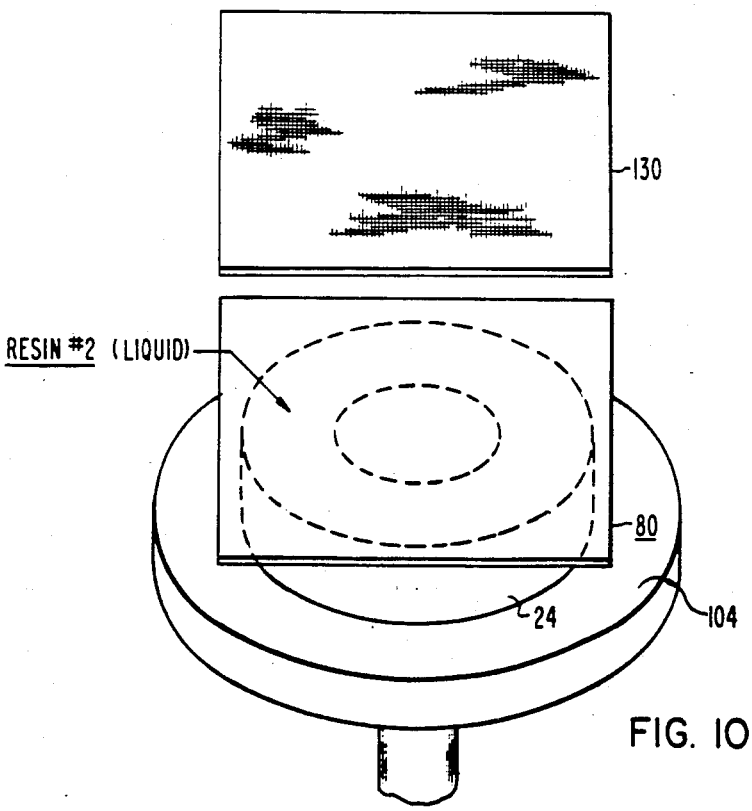
FIG. 10 illustrates another step in the method of constructing the outer high strength structure of the conformal, composite coating, which includes applying a impregnable, reinforcing fabric sheet to the liquid resin applied in the step of FIG. 9.
Figure 11:
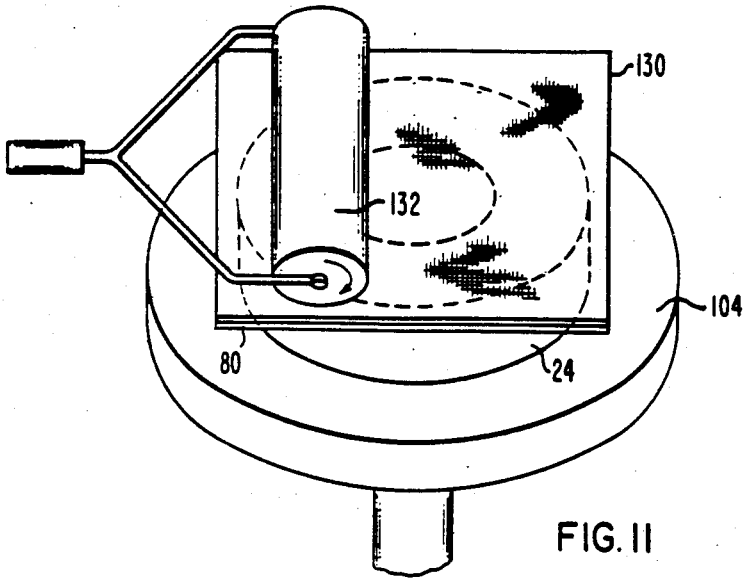
FIG. 11 illustrates pressing the reinforcing fabric sheet, applied in the step of FIG. 10, into the liquid resin, to thoroughly impregnate the sheet.
Figure 12:
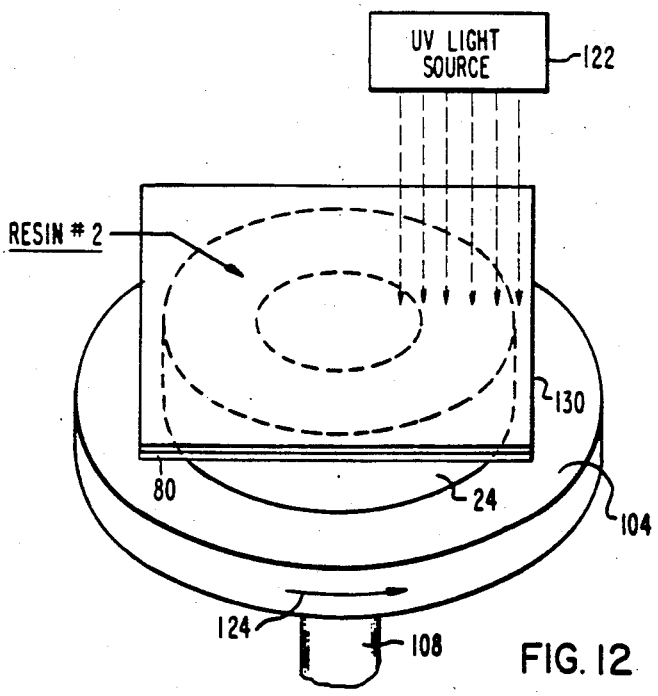
FIG. 12 illustrates radiation gelling of the liquid resin which permeates the reinforcing sheet.

After resin No. 2 has been applied, an impregnable reinforcing sheet 130, shown in FIG. 10, is placed on the liquid resin. Sheet 130 may be the same fiberglass cloth used in the second layer of the flexible structure, i.e., grade 2116. FIG. 11 illustrates the step of pressing sheet 130 into the liquid resin, in order to thoroughly impregnate it, such as by using a roller 132. FIG. 12 illustrates gelling resin No. 2 with UV light. Additional layers of resin impregnated reinforcing sheets may be applied as up the high strength section 82 of the composite conformal coating 74.

The layers of coating 74 which have not been previously trimmed, may now be trimmed at this time, and the male portion 106 of the mandrel is placed into the core window. A metal plate is placed on the top of the core, and the whole assembly is then inverted such that the plate just applied to the top of the core now becomes the bottom support plate. The male portion of the mandrel is then removed, and the process is repeated to create the composite, conformal coating 76 on flat side 26' of magnetic core 24.

Figure 13:
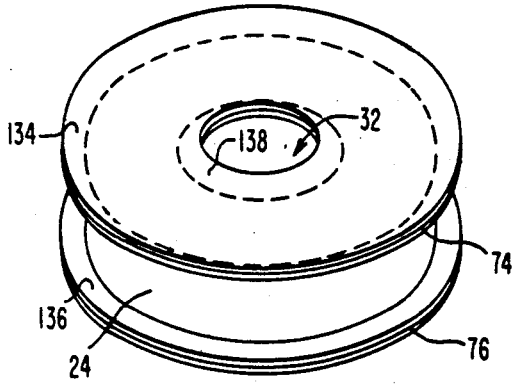
FIG. 13 illustrates a trimming configuration which may be used to trim the composite conformal coatings.

As shown in FIG. 13, when the whole core 24 is constructed of amorphous metal, coatings 74 and 75 may be trimmed to provide overhangs 134 and 136, respectively, on the outer periphery of magnetic core 24, and similar overhangs, such as overhang 138, may be created adjacent to the core window. These overhangs will ensure that the core 24 is not damaged during trimming, and the overhangs will additionally protect the core edges when electrical windings are wound about the core. When grain oriented electrical steel is used to protect the inner and outer surfaces and edges of the amorphous core, coatings 74 and 76 may be closely trimmed, as shown in FIG. 14.

Figure 14:
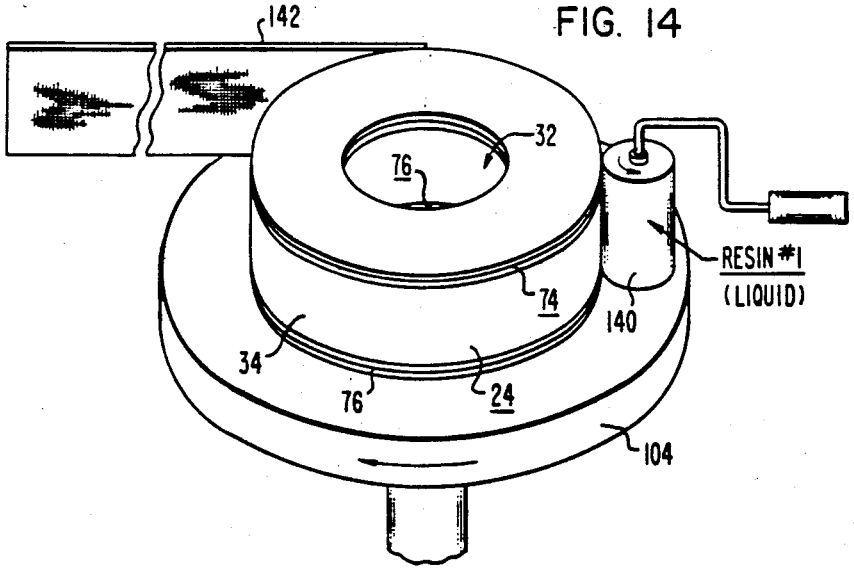
FIG. 14 illustrates another step of the new and improved method which includes applying a liquid resin to the outer periphery of the magnetic core, and applying an impregnable reinforcing fabric sheet to the resin.
Figure 15:
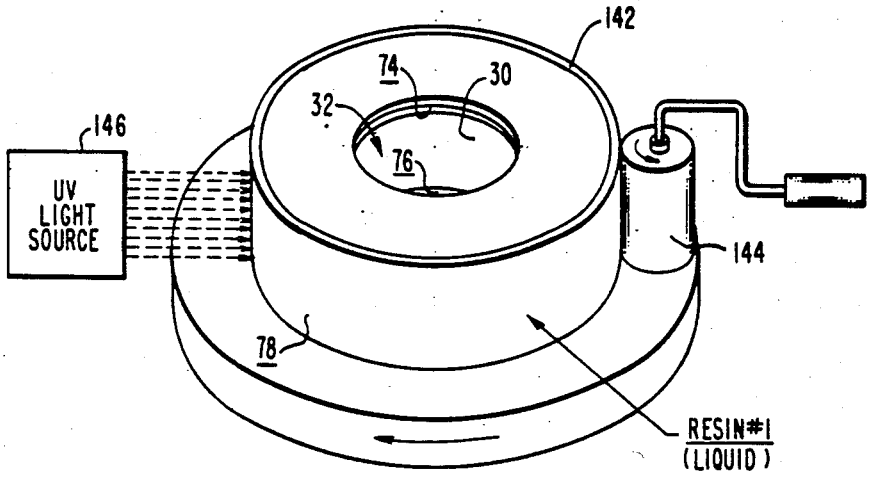
FIG. 15 illustrates pressing the reinforcing sheet applied in the step of FIG. 14 into the liquid resin, to thoroughly impregnate the sheet and it also illustrates the radiation gel of the resin.

FIG. 14 also illustrates another step of the method which includes the application of the low stress conformal coating 78 on the outer surface or periphery 34 of magnetic core 24. When the overhangs 134 and 136 shown in FIG. 13 are used, coating 78 would be applied prior to coatings 74 and 76. When overhangs are not used, coating 78 may be applied before or after coatings 74 and 76, as desired. In the application of coating 78, resin No. 1 is applied to surface 34, such as via a roller 140, and a strip 142 of fiberglass cloth, such as grade 2116, is applied to the wet resin. Strip 142 is pressed uniformly into the wet resin, such as with roller 144 shown in FIG. 15, and the resin impregnated strip 142 is radiation gelled via a UV light source 146. An additional layer, or layers, of fiberglass cloth and resin may be applied to complete the low stress conformal coatings 78 on the outside of core 24, as required to reinforce and protect the outer edges of the core.

If the innermost lamination turn of the core is amorphous metal, an insulative film of plastic or paper should be applied thereto for silver containment. A film of resin No. 1 could be used instead of the plastic or paper film, but the curing process would be more difficult.

Resins No. 1 and No. 2 will both gain strength when advanced to final cure with heat, and they become temporarily adhesive as they are advanced from the B-stage to final cure. Since resin No. 1 temporarily becomes adhesive during such a post-cure, it will bond core sections together, such as core sections 66 and 68 shown in FIG. 2. As hereinbefore stated, the core surfaces to be bonded to adjacent core surfaces of other core sections need only have the low stress portion of the conformal coating applied. Such a post cure may be performed in a separate heating operation, such as four hours in an oven with the core temperature at 130° C., or the post cure may be achieved simultaneously with subsequent manufacturing operations of the transformer, such as the operations which utilize heat to bond and dry paper insulation and then impregnate the transformer with mineral oil, or other liquid dielectric.

While the method has been primarily described relative to wound toroidal core 24, the same method steps would apply equally to develop a composite conformal coating on any magnetic core containing amorphous metal, such as the wound rectangular core 48 shown in FIG. 2, and even on the leg and yoke portions of stacked cores.

I claim as my invention:

1. A magnetic core, comprising:

a plurality of lamination layers, at least certain of which are constructed of amorphous metal, said plurality of lamination layers defining closely adjacent edges on opposite sides of the magnetic core, and a composite, conformal coating disposed to cover at least said opposite sides of said magnetic core, said composite, conformal coating including a low stress, adhesive insulative structure having at least one foraminous insulative sheet thoroughly impregnated with a first gelled resin, said low stress insulative structure being bonded to the adjacent edges of the lamination layers on said opposite sides of the magnetic core, without penetration of the low stress insulative structure between the lamination layers, said composite, conformal coating further including a high strength structure having at least one reinforcing insulative sheet thoroughly impregnated with a second resin which has a higher tensile strength than said first resin, said high strength structure being bonded to said low stress insulative structure, to provide a composite, conformal coating which protects the magnetic core against mechanical stresses while maintaining the desired core configuration.

2. The magnetic core of claim 1 wherein the plurality of lamination layers defines a wound core having a circular cross-sectional configuration, with the at least one foraminous insulative sheet including a single sheet of fiberglass cloth.

3. The magnetic core of claim 1 wherein the plurality of lamination layers define a wound core having a non-circular cross-sectional configuration which defines leg and yoke portions, with the at least one foraminous insulative sheet of the low stress, adhesive insulative structure being constructed of separate strips of fiberglass cloth applied to the leg and yoke portions.

4. The magnetic core of claim 1 wherein the plurality of lamination layers are the turns of a wound core which define inner and outer core surfaces, and wherein the low stress, adhesive insulative structure is also bonded to said outer core surface.

5. The magnetic core of claim 1 wherein the plurality of lamination layers are the turns of a wound core, with at least the innermost lamination layer turn being formed of a non-amorphous metal.

6. The magnetic core of claim 1 wherein the plurality of lamination layers are the turns of a wound core, with at least the innermost and outermost lamination layer turns being formed of a non-amorphous metal, and with the intermediate lamination layer turns being formed of an amorphous metal.

7. The magnetic core of claim 1 wherein the composite coating overhangs at least certain of the core edges by a predetermined dimension.

* * * * *